US010276967B2

(12) United States Patent
Ngo

(10) Patent No.: US 10,276,967 B2
(45) Date of Patent: Apr. 30, 2019

(54) ELECTRICAL CONNECTOR INCLUDING LATCH ASSEMBLY

(71) Applicant: FCI USA LLC, Etters, PA (US)

(72) Inventor: Hung Viet Ngo, Etters, PA (US)

(73) Assignee: FCI USA LLC, Etters, PA (US)

( * ) Notice: Subject to any disclaimer, the term of this patent is extended or adjusted under 35 U.S.C. 154(b) by 66 days.

(21) Appl. No.: 15/548,824

(22) PCT Filed: Jan. 27, 2016

(86) PCT No.: PCT/US2016/015017

§ 371 (c)(1),
(2) Date: Aug. 4, 2017

(87) PCT Pub. No.: WO2016/126468

PCT Pub. Date: Aug. 11, 2016

(65) Prior Publication Data

US 2018/0034190 A1 Feb. 1, 2018

Related U.S. Application Data

(60) Provisional application No. 62/112,557, filed on Feb. 5, 2015.

(51) Int. Cl.
*H01R 13/514* (2006.01)
*H01R 13/639* (2006.01)
(Continued)

(52) U.S. Cl.
CPC ..... *H01R 13/514* (2013.01); *H01R 12/7047* (2013.01); *H01R 12/714* (2013.01);
(Continued)

(58) Field of Classification Search
CPC ..... H01R 13/6272; H01R 2107/00; H01R 13/6471; H01R 13/4538; H01R 13/506;
(Continued)

(56) References Cited

U.S. PATENT DOCUMENTS 4,820,169 A 4/1989 Weber et al.
5,024,609 A * 6/1991 Piorunneck ..... H01R 12/721 439/60
(Continued)

FOREIGN PATENT DOCUMENTS

CN 201417871 Y 3/2010
GB 2439980 A 1/2008
JP 05-048237 U 6/1993

OTHER PUBLICATIONS

International Search Report and Written Opinion for International Application No. PCT/US2016/015017 dated Apr. 29, 2011.
Extended European Search Report for European Application No. 16746982.4 dated Aug. 24, 2018.

*Primary Examiner* — Truc Nguyen
(74) *Attorney, Agent, or Firm* — Wolf, Greenfield & Sacks, P.C.

(57) ABSTRACT

Methods and apparatus are disclosed for supporting first and second electrical connectors on a substrate. For instance, the first electrical connector includes electrical contacts that are configured to be mounted to the substrate. The second electrical connector includes electrical contacts that are configured to be mounted to a complementary electrical component other than the substrate. The second electrical connector is thus configured to be attached to the first electrical connector, such that the second electrical is supported by the substrate without being mounted to the substrate.

20 Claims, 11 Drawing Sheets

(51) Int. Cl.

| | |
|---|---|
| ***H01R 13/74*** | (2006.01) |
| ***H01R 12/70*** | (2011.01) |
| ***H01R 12/71*** | (2011.01) |
| ***H01R 43/20*** | (2006.01) |
| ***H01R 27/02*** | (2006.01) |

(52) U.S. Cl.
CPC ..... *H01R 13/639* (2013.01); *H01R 13/74* (2013.01); *H01R 27/02* (2013.01); *H01R 43/205* (2013.01)

(58) Field of Classification Search
CPC ..... H01R 13/639; H01R 13/641; H01R 13/6658; H01R 13/405; H01R 13/4223; H01R 13/4362; H01R 13/502; H01R 13/514; H01R 13/64
See application file for complete search history.

(56) References Cited

U.S. PATENT DOCUMENTS

| | | | | |
|---|---|---|---|---|
| 5,211,585 | A * | 5/1993 | Douty | H01R 13/64 439/248 |
| 5,575,690 | A * | 11/1996 | Eaton | H01R 13/187 439/176 |
| 6,179,650 | B1 | 1/2001 | Chih-Kai | |
| 6,375,517 | B1 | 4/2002 | Okabe et al. | |
| 8,435,047 | B2 * | 5/2013 | Patel | H01R 13/514 439/532 |
| 2010/0022116 | A1 | 1/2010 | Xu et al. | |
| 2010/0240256 | A1 | 9/2010 | Bailey et al. | |
| 2011/0111625 | A1 | 5/2011 | Chang | |
| 2012/0094512 | A1 * | 4/2012 | Northey | G09B 19/00 439/116 |
| 2015/0147910 | A1 * | 5/2015 | Johnescu | H01R 12/7047 439/574 |

* cited by examiner

ELECTRICAL CONNECTOR INCLUDING LATCH ASSEMBLY

RELATED APPLICATIONS

This application is the U.S. National Stage of and claims priority to and the benefit of International Patent Application Number PCT/US2016/015017, entitled "ELECTRICAL CONNECTOR INCLUDING LATCH ASSEMBLY" filed on Jan. 27, 2016, which claims priority under 35 U.S.C. § 119(e) to U.S. Provisional Application Ser. No. 62/112,557, entitled "ELECTRICAL CONNECTOR INCLUDING LATCH ASSEMBLY" filed on Feb. 5, 2015, which is herein incorporated by reference in its entirety. The entire contents of these applications are incorporated herein by reference in their entirety.

BACKGROUND

Electrical connectors include a connector housing that carries a plurality of electrical contacts configured to electrically connect a pair of electrical components. For instance, certain electrical connectors can be configured to be mounted to an electrical component at one end, and are configured to be mated to a complementary electrical device at another end, thereby placing the complementary electrical device in electrical communication with the electrical component. Electrical connectors can be configured to transmit electrical power, signal data, or a combination of power and signal data. In some instances, the electrical component can be configured as a printed circuit board, such as a midplane, backplane, or the like. In other instances, the electrical component can be a cable, such as an electrical power cable. In certain architectures, it is desirable to support multiple electrical connectors on a common printed circuit board.

SUMMARY

In accordance with one aspect of the present disclosure, an electrical connector assembly can include first electrical connector that, in turn, includes a dielectric first connector housing, and a first plurality of electrical contacts supported by the first connector housing. The first electrical connector can be configured to be mounted to a first surface of a substrate that defines a second surface opposite the first surface in a first direction. The electrical connector assembly can further include a second electrical connector that, in turn, includes a dielectric second connector housing, and a second plurality of electrical contacts supported by the second connector housing. The second electrical connector can be configured to be moved relative to the first electrical connector along an engagement direction perpendicular to the first direction so as to attach the second electrical connector to the first electrical connector after the first electrical connector has been mounted to the first surface of the substrate.

BRIEF DESCRIPTION OF THE DRAWINGS

The foregoing summary, as well as the following detailed description of an example embodiment of the application, will be better understood when read in conjunction with the appended drawings, in which there is shown in the drawings an example embodiment for the purposes of illustration. It should be understood, however, that the application is not limited to the precise arrangements and instrumentalities shown. In the drawings.

DETAILED DESCRIPTION

Figure 1A:
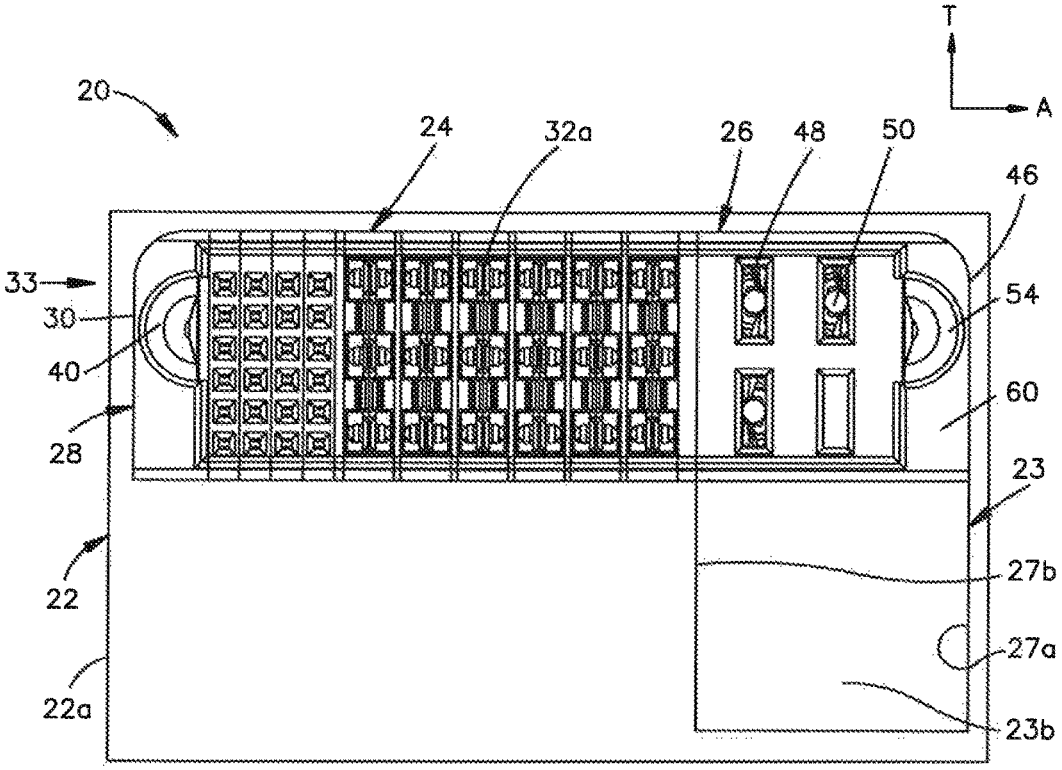
FIG. 1A is a perspective view of an electrical system including a substrate, a first electrical connector mounted to the substrate, and a second electrical connector attached to the first electrical connector and secured to the substrate.
Figure 1B:
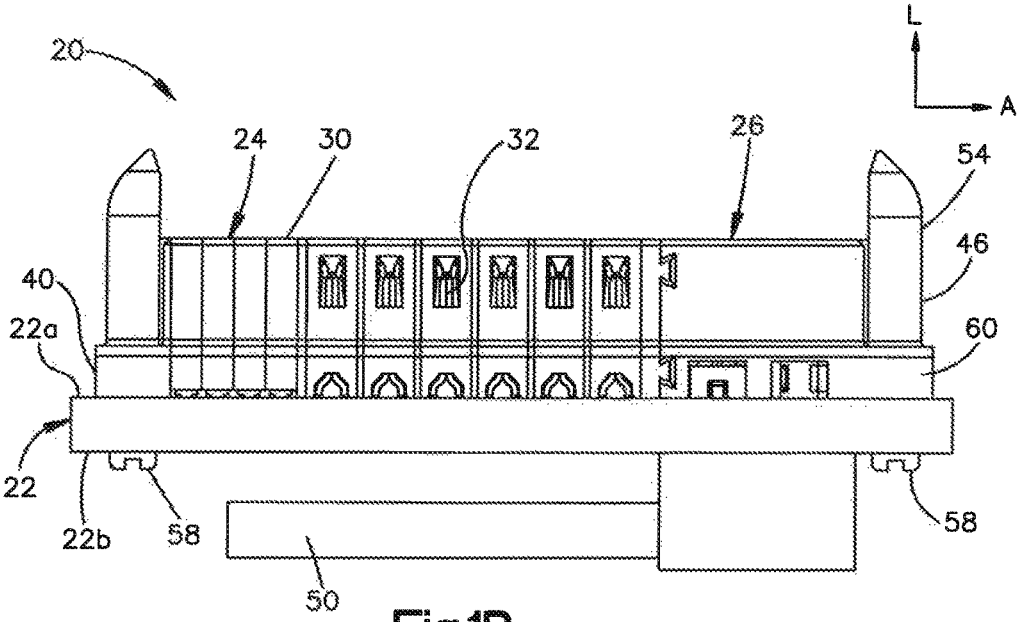
FIG. 1B is a top plan view of the electrical system illustrated in FIG. 1A.
Figure 1C:
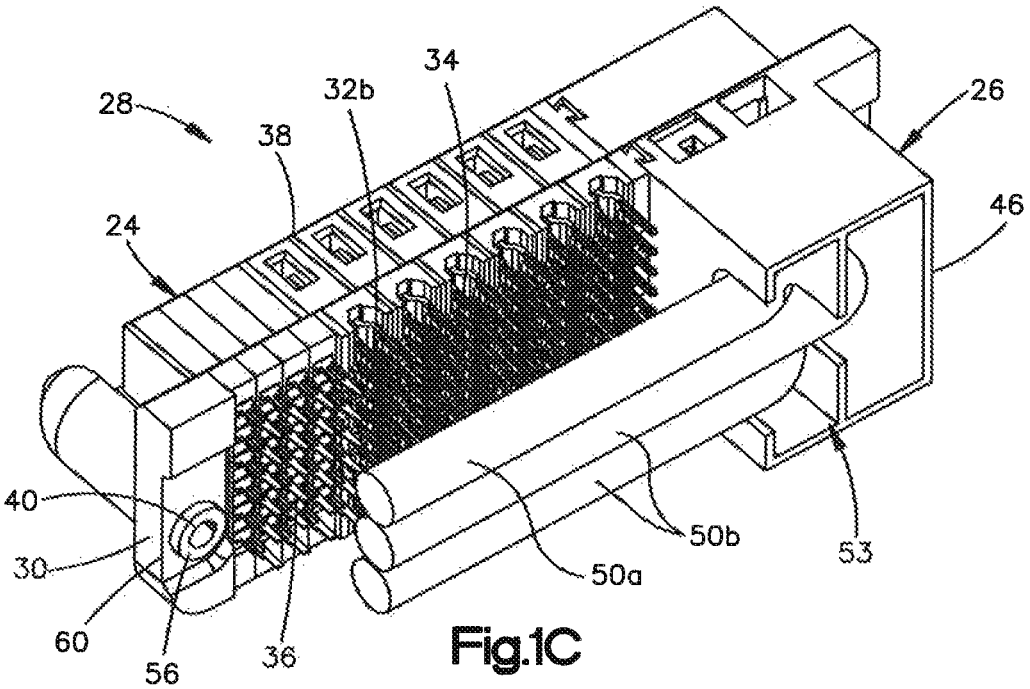
FIG. 1C is a perspective view of an electrical connector assembly of the electrical system illustrated in FIG. 1A, the electrical connector assembly including the first and second electrical connectors illustrated in FIG. 1A, shown attached to each other.

Referring to FIG. 1, an electrical system 20 can include a substrate 22, a first electrical connector 24 that is configured to be mounted to the substrate, and a second electrical connector 26 that is configured to be supported by the first electrical connector and secured to the substrate. For instance, the second electrical connector 26 is configured to be supported by the first electrical connector 24 and secured directly to the substrate 22 without having electrical contacts that are mounted to the substrate 22. Further, the second electrical connector 26 is configured to be supported by the first electrical connector 24 and secured to the substrate 22 while disposed within an outer perimeter of the substrate 22. For instance, the second electrical connector 26 can extend through an opening 23 of the substrate 22. The first and second electrical connectors can define an electrical connector assembly 28.

The substrate 22 defines a first surface 22*a* and a second surface 22*b* that is opposite the first surface 22*a* along a first direction which can be referred to as a longitudinal direction L. Each of the first and second surfaces 22*a* and 22*b* can be planar along respective parallel planes that are defined by a second direction, which can be referred to as a transverse direction T, and a third direction, which can be referred to as a lateral direction A. The transverse direction T is perpendicular to the longitudinal direction L. The lateral direction A is perpendicular to each of the longitudinal direction L and the transverse direction T. The substrate 22 can be configured as a printed circuit board. For instance, the substrate 22 can be configured as a midplane. Alternatively, the substrate 22 can be configured as a backplane or any suitable alternative printed circuit board as desired. The opening 23 can extend through the substrate 22 along the longitudinal direction L from the first surface 22*a* to the second surface 22*b*.

Figure 2A:
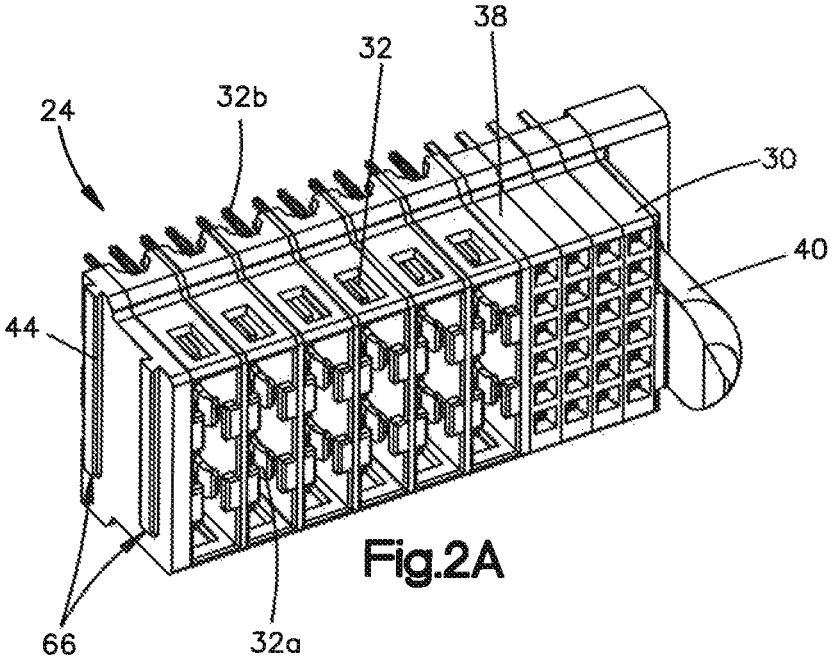
FIG. 2A is a perspective view of the first electrical connector illustrated in FIG. 1A.
Figure 2B:
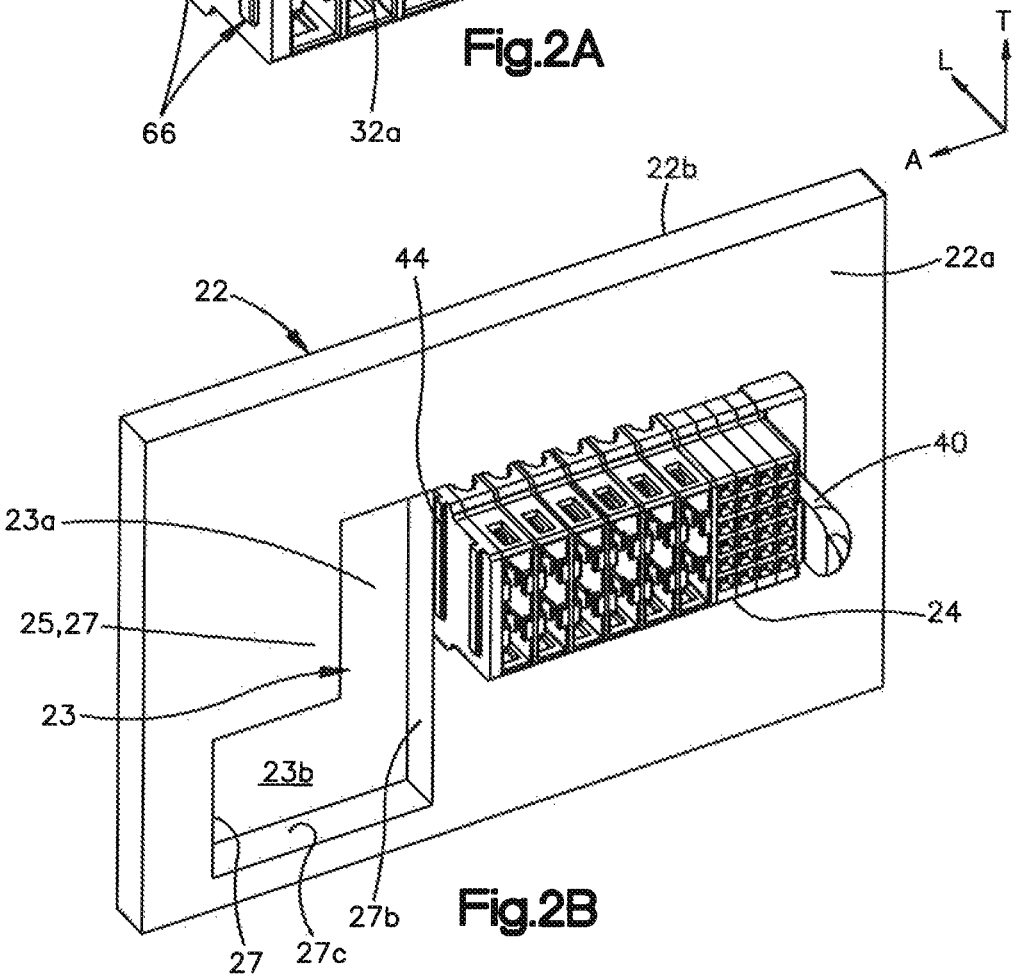
FIG. 2B is a perspective view of a portion of the electrical system, showing the first electrical connector mounted to the substrate.
Figure 2C:
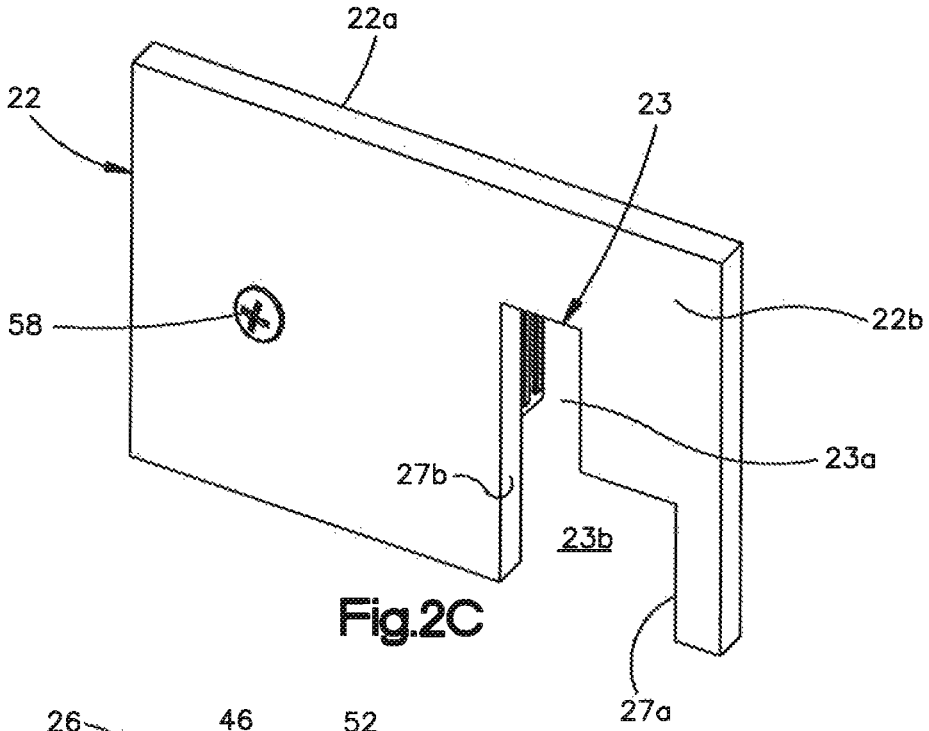
FIG. 2C is another perspective view of the portion of the electrical system illustrated in FIG. 2B.

Referring also to FIGS. 2A-2C, the first electrical connector 24 is configured to be mounted to the substrate 22, and in particular to the first surface 22*a* of the substrate 22. For instance, the first electrical connector 24 includes a dielectric or electrically insulative first connector housing 30 and a first plurality of electrical contacts 32 that are supported by the first connector housing 30. The first plurality of electrical contacts 32 define respective mating ends 32*a* and mounting ends 32*b* opposite the mating ends 32*a*. When the first electrical connector 24 is mounted to the substrate 22, the first plurality of electrical contacts 32 are placed in electrical communication with the substrate 22. The mating ends 32*a* are configured to mate with a complementary electrical device so as to place the first electrical connector 24 in electrical communication with the complementary electrical device. The complementary electrical device can be configured as an electrical connector or any suitable alternative electrical device as desired. When the mounting ends 32*b* are mounted to the substrate 22 and the mating ends 32*a* are mated with the complementary electrical device, the first electrical connector 24 places the substrate in electrical communication with the complementary electrical device.

In one example, the mounting ends 32*b* can be configured as press-fit tails that are configured for insertion into corresponding apertures defined by the substrate 22. Alternatively, the mounting ends 32*b* can be configured to be surface mounted to the substrate 22. The first plurality of electrical contacts 32 can include electrical power contacts 34. Alternatively or additionally, the first plurality of electrical contacts 32 can include electrical signal contacts 36. The electrical contacts 32 can be constructed as described in U.S. Pat. No. 7,220,141, or in accordance with any suitable alternative embodiment as desired. Thus, in one example, certain ones of the mating ends 32*a* can be configured as receptacles, and other ones of the mating ends 32*a* can be configured as plugs or headers. The electrical contacts 32 can be arranged in rows 33 that are spaced from each other in a second direction that is perpendicular to the first direction. The second direction can also be referred to as a transverse direction T. The rows 33 can be oriented along the lateral direction A. It should be appreciated, of course, that the first electrical connector 24 can be constructed in accordance with any suitable alternative embodiment as desired.

The first electrical connector 24 can be configured as a vertical electrical connector whereby the mating ends 32*a* and the mounting ends 32*b* oriented parallel to each other, and inline with each other. For instance, the mating ends 32*a* and the mounting ends 32*b* can be oriented along the longitudinal direction L. Alternatively, the first electrical connector 24 can be configured as a right angle electrical connector whereby the mating ends 32*a* and the mounting ends 32*b* are oriented perpendicular with respect to each other.

The first connector housing 30 can include a first housing body 38, such that the first plurality of electrical contacts 32 can be supported by the first housing body 38. The first connector housing 30 can further include a securement member 40 that is supported by the first housing body 38. The securement member 40 can be monolithic with the first housing body 38. Alternatively, the securement member 40 can be separate from the first housing body 38 and attachable to the first housing body 38. In one example, the securement member 40 can be configured to receive a suitable fastener 58 that is configured to be inserted through an aperture 42 of the substrate 22, and into the securement member 40 so as to secure first electrical connector 24 to the substrate 22. For instance, the fastener 58 can threadedly mate with the first connector housing 30 in the aperture defined by the securement member 40.

The first connector housing 30 can further include a first attachment member 44 that is supported by the first housing body 38. For instance, the first attachment member 44 can be monolithic with the first housing body 38, attached to the first housing body 38, or otherwise supported by the first housing body 38 as desired. The first attachment member 44 is configured to attach to a complementary second attachment member of the second electrical connector 26 when the second electrical connector is moved with respect to the first electrical connector 24 in an engagement direction that is perpendicular to the longitudinal direction L, as will be described in more detail below.

Figure 3A:
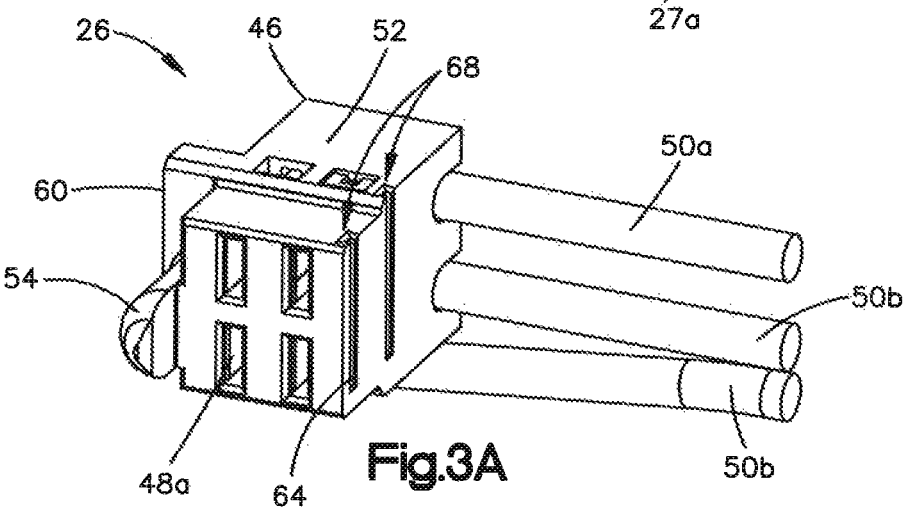
FIG. 3A is a perspective view of the second electrical connector illustrated in FIG. 1A.
Figure 3B:
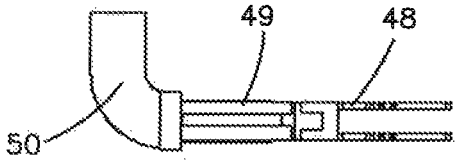
FIG. 3B is a perspective view of an electrical contact of the second electrical connector illustrated in FIG. 3A shown mounted to an electrical cable.
Figure 3C:
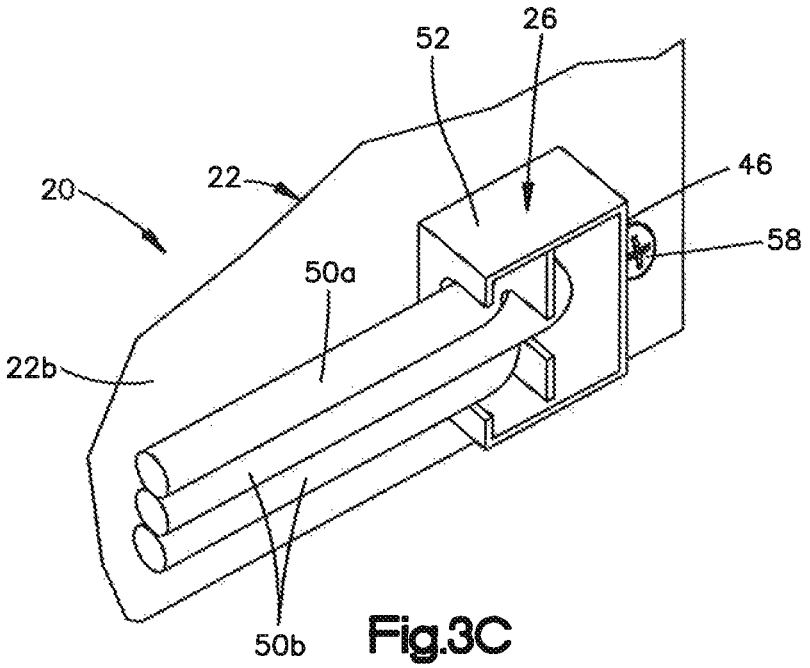
FIG. 3C is another perspective view of the second electrical connector illustrated in FIG. 3A.

Referring now also to FIGS. 3A-3C, the second electrical connector 26 includes a dielectric or electrically insulative second connector housing 46, and a second plurality of electrical contacts 48 supported by the second connector housing 46. The second plurality of electrical contacts 48 define respective mating ends 48*a* and mounting ends opposite the mating ends 48*a*. The mounting ends are configured to be mounted to a complementary electrical component other than the substrate 22. For instance, the mounting ends are configured to be mounted to a respective one of a plurality of electrical cables 50. Thus, each mounting end of the second plurality of electrical contacts 48 is configured to be placed in electrical communication with a respective electrical cable 50. It is recognized that depending on the system architecture, all of the mounting ends of the second plurality of electrical contacts 48 need not be placed in electrical communication with a respective cable 50. Thus, it can be said that at least some of the second plurality of electrical contacts 48 can be connected to a respective one of the electrical cables 50.

For instance, in accordance with one embodiment, one of the second plurality of electrical contacts 48 is not mounted to a complementary electrical component. Another one of the second plurality of electrical contacts 48 can be mounted to a ground cable 50*a*. Other ones of the second plurality of electrical contacts 48 can be mounted to electrical power cables 50*b*. Accordingly, the second electrical connector 26 can be referred to as a cable connector. The mating ends 48*a* are configured to mate with a complementary electrical device so as to place the second electrical connector 26 in electrical communication with the complementary electrical device. When the second plurality of electrical contacts 48 are mounted to the electrical cables 50 and the mating ends 48*a* are mated with the complementary electrical device, the second electrical connector 26 places the complementary electrical device in electrical communication with the electrical cables 50, thereby allowing electrical power to flow between the complementary electrical device and the electrical power cables 50*b*. The second electrical connector 26 can include an electrically insulative sleeve 49 that covers the interface between the electrical contact 48 and the respective cable 50. For instance, the electrical contact 48 can be crimped about the cable 50, and the insulation sleeve 49 can cover the crimp connection. The second electrical connector 26 can further include a retention member that is inserted into the second connector housing 46 so as to retain the electrical contact 48 and cable 50 in the second connector housing 46.

At least one of the electrical cables 50 up to all of the electrical cables 50 can extend out from the second connector housing 46 along a direction perpendicular to the longitudinal direction L. For instance, the at least one of the electrical cables 50 can extend out from the second connector housing 46 along the lateral direction A. The second connector housing 46 can define at least one opening 53 in its rear surface that receive respective ones of the electrical cables 50 so as to direct the electrical cables in the lateral direction A. In this regard, the second connector housing 46 defines a front surface and the rear surface that is spaced from the front surface in a rearward direction from the mating ends 48*a* to the mounting ends. It is appreciated that the lateral direction A includes a first select direction and a second select direction that is opposite the first select direction. The first electrical connector 24 can be disposed adjacent the second electrical connector 26 in the first select direction along the lateral direction A, and the electrical cables 50 can extend out from the second connector housing 46 in the first select direction.

The second electrical connector 26 can be configured as a vertical electrical connector whereby the mating ends 48*a* and the mounting ends are oriented parallel to each other and inline with each other. For instance, the mating ends 48*a* and the mounting ends can be oriented along the longitudinal direction L. Alternatively, the second electrical connector 26 can be configured as a right angle electrical connector whereby the mating ends 48*a* and the mounting ends are oriented perpendicular with respect to each other. The mating ends 48*a* can be configured as receptacles that are configured to receive complementary electrical contacts of the complementary electrical device. Alternatively, the mating ends 48*a* can be configured as plugs or headers that are configured to be received in complementary electrical contacts of the complementary electrical device. The complementary electrical device can be configured as an electrical connector or any suitable alternative electrical device as desired. The first and second electrical connectors 24 and 26 can made with a common complementary electrical device or different complementary electrical devices as desired.

The second connector housing 46 can include a second housing body 52, such that the second plurality of electrical contacts 48 can be supported by the second housing body 52. The second housing body 52 includes opposed side walls 70 that are spaced from each other along the lateral direction A that is perpendicular to the transverse direction T and the longitudinal direction L. The second connector housing 46 can further include an engagement member 54 that is configured to facilitate securement of the second electrical connector 26 to the substrate 22. For instance, the engagement member 54 can extend from the second housing body 52. Alternatively, the engagement member 54 can be defined by the second housing body 52. It will be appreciated in one embodiment that the second plurality of electrical contacts 32 are free from electrical communication with the substrate 22 when the second electrical connector 26 is secured to the substrate 22. That is, the mounting ends of the second plurality of electrical contacts 48 are not mounted to the substrate 22. Rather, they are mounted to a complementary electrical component that is different than the substrate, such as the electrical cables 50.

Figure 1D:
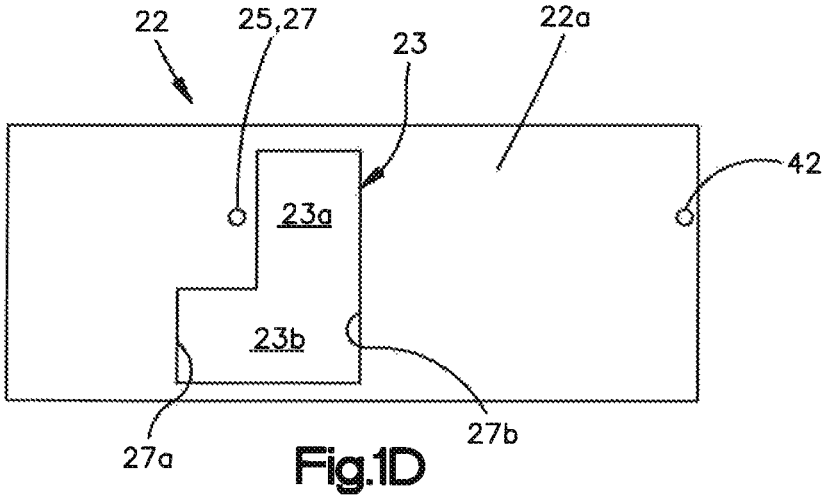
FIG. 1D is a side elevation view of the substrate illustrated in FIG. 1A.
Figure 4A:
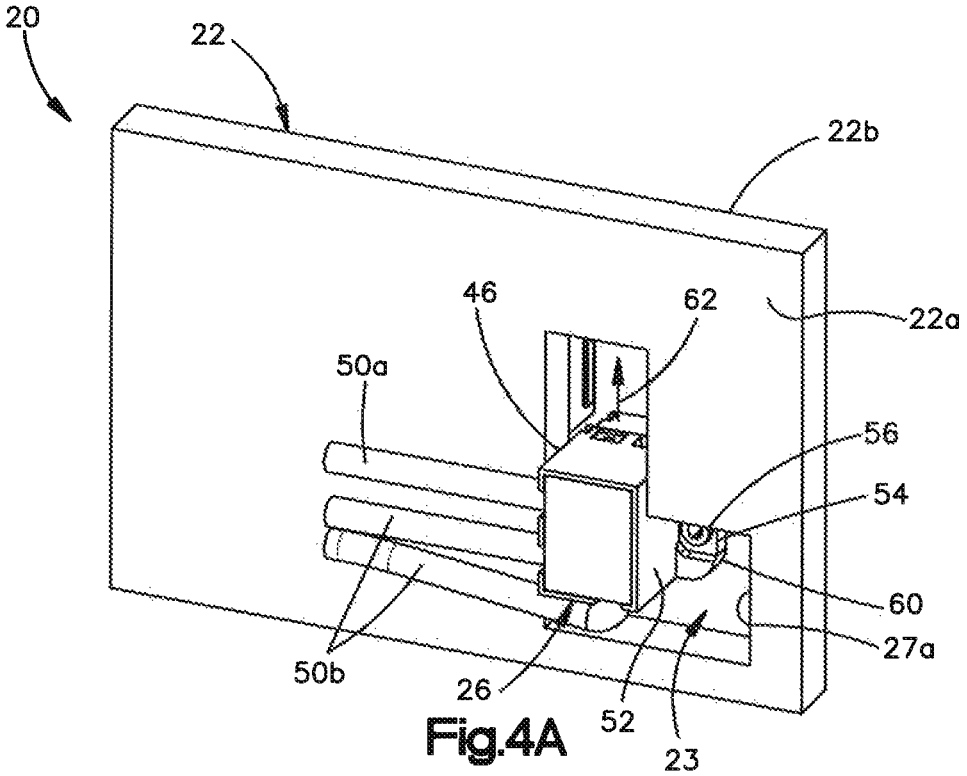
FIG. 4A is a perspective view showing attachment of the second electrical connector to the first electrical connector.
Figure 4B:
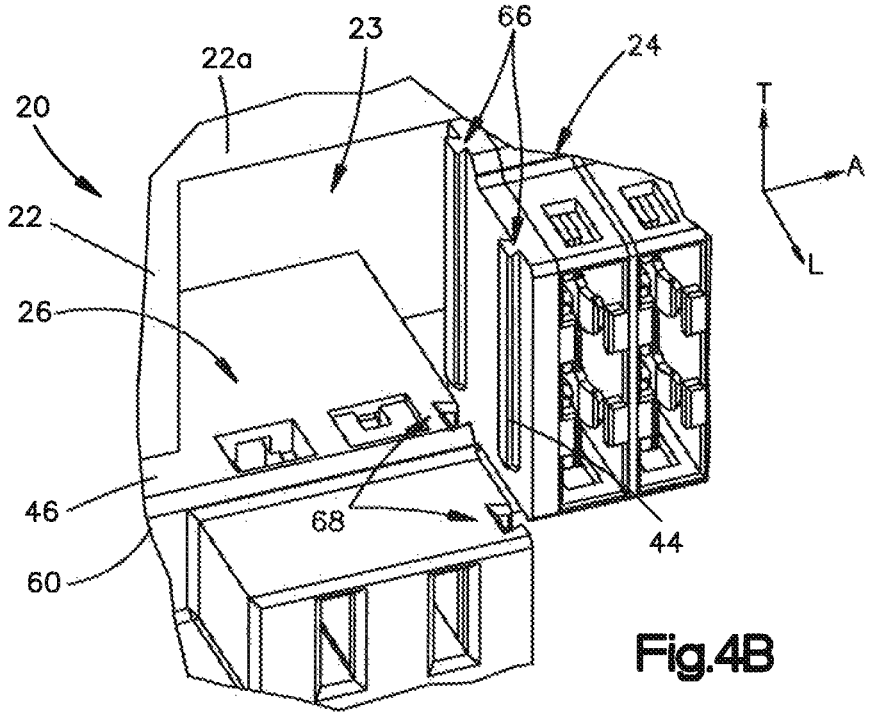
FIG. 4B is another perspective view showing attachment of the second electrical connector to the first electrical connector.
Figure 4C:
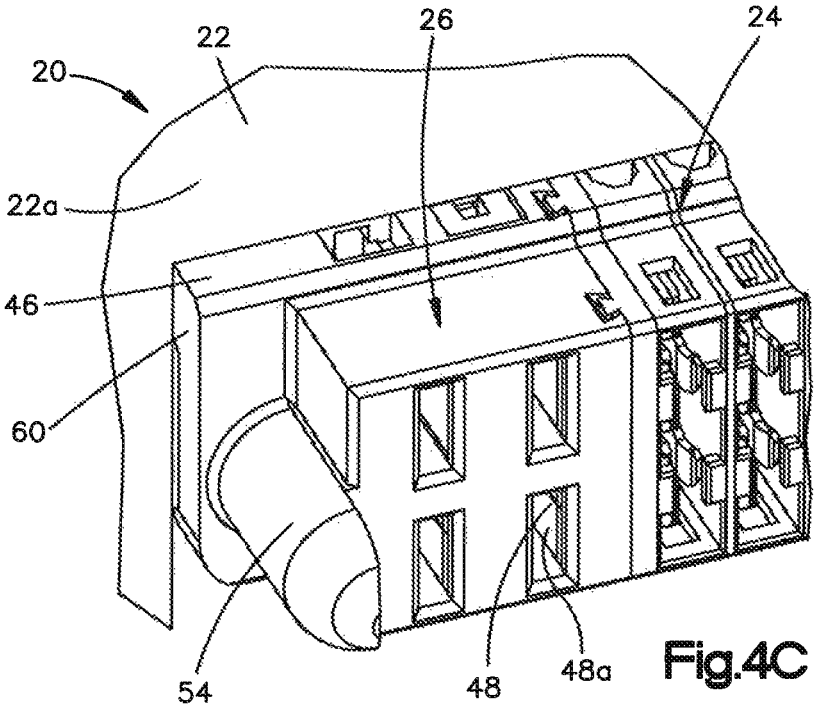
FIG. 4C is a perspective view showing the second electrical connector attached to the first electrical connector.
Figure 4D:
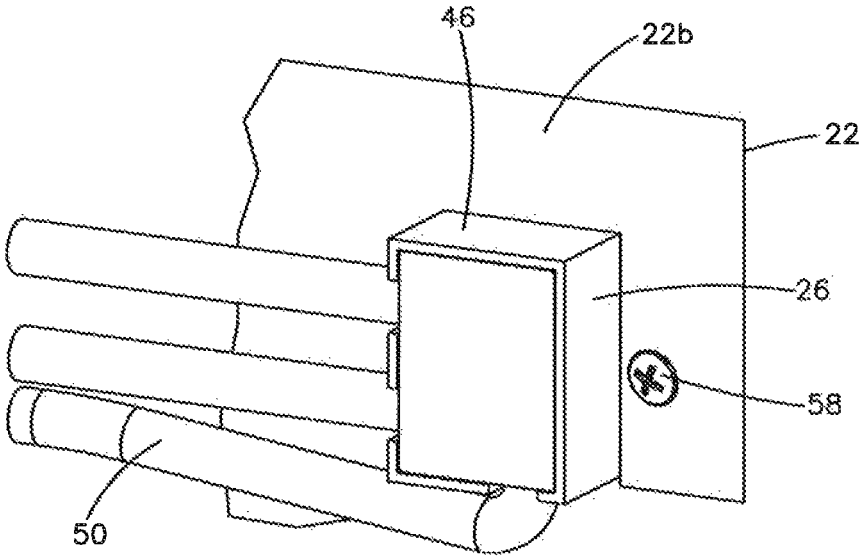
FIG. 4D is a perspective view showing the second electrical connector secured to the substrate.
Figure 4E:
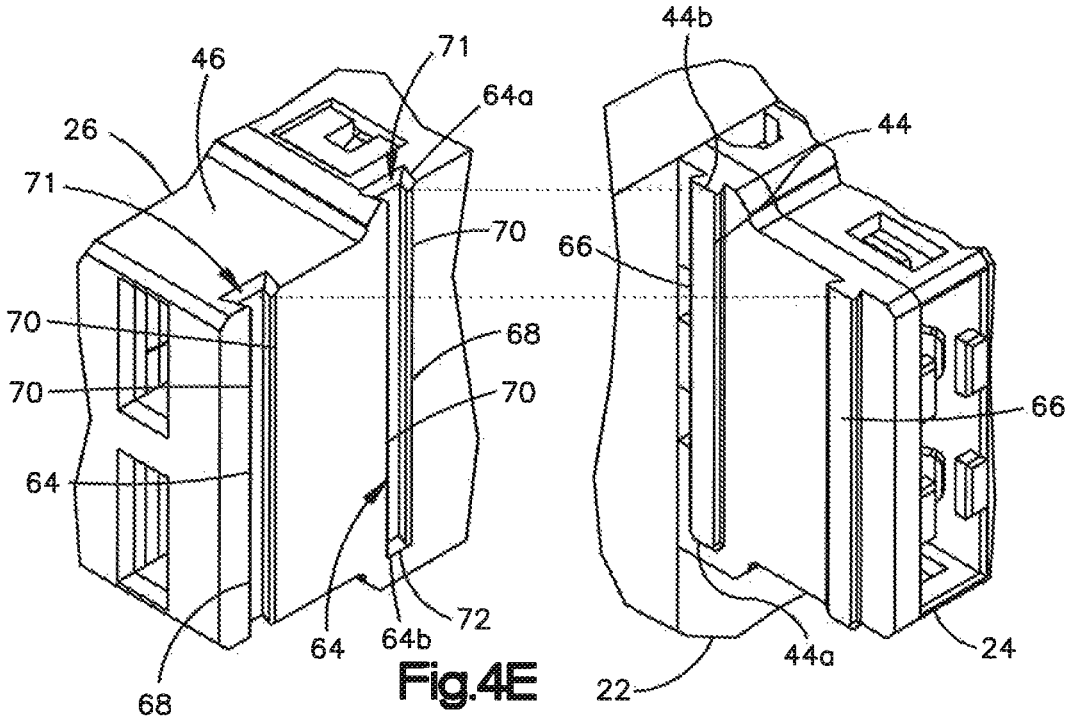
FIG. 4E is an exploded perspective view of the electrical connector assembly illustrated in FIG. 1C.
Figure 4F:
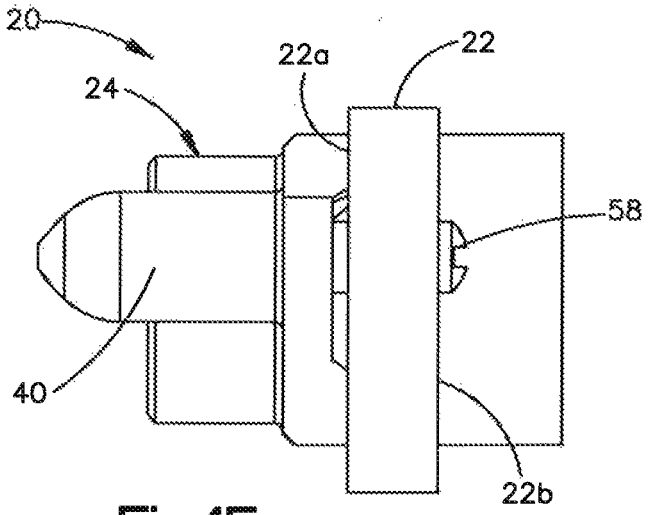
FIG. 4F is a side elevation view of the electrical system.

Referring now also to FIG. 1D, the substrate 22 can further include an engagement member 25 that is configured to cooperate with the engagement member 54 of the second electrical connector 26 so as to secure the second electrical connector 26 to the substrate 22. As illustrated in FIG. 4A, the engagement member 54 can be defined as first aperture 56 that extends at least into the second connector housing 46. In one example, the second connector housing 46 can include a flange 60 that extends from the second housing body 52. The flange 60 can define the engagement member 54. For instance, the aperture 56 can extend at least into or through the flange 60. The engagement member 25 of the substrate 22 can be configured as a second aperture 27 that extends through the substrate 22 along the longitudinal direction L from the first surface 22*a* to the second surface 22*b*. One of the first and second apertures 56 and 27 is configured to receive a fastener that extends therethrough and at least into the other one of the first and second apertures 56 and 27 so as to secure the second electrical connector 26 to the substrate 22. The electrical connector assembly 28 can further include a fastener 58 that is configured to extend through one of the apertures 27 and 56 and at least into the other one of the apertures 27 and 56. For instance, the fastener 58 can be configured as a screw that threadedly mates in the other one of the apertures 27 and 56. The aperture 56 can be threaded so as to be configured to threadedly purchase with the fastener 58. The aperture 27 of the substrate 22 can be sized to receive the fastener 58 such that the fastener 58 can extend through the aperture 27 and can threadedly attach to the flange 60 in the aperture 56.

Referring now to FIGS. 2B-2C, the opening 23 of the substrate 22 can be defined by first and second opposed internal side walls 27*a* and 27*b* of the substrate 22. The opening 23 can have a width measured from the first side wall 27*a* to the second side wall 27*b* along the lateral direction A. The distance can be greater than the width of the second housing body 52 along the lateral direction. Accordingly, as illustrated in FIG. 4A, the second electrical connector 26 can be disposed in the opening 23 and moved in an engagement direction 62 along the transverse direction T so as to attach the second electrical connector 26 to the first electrical connector 24 as is described in more detail below. Thus, the engagement direction 62 can be parallel to a plane that is defined by the first surface 22*a* of the substrate 22. The opening 23 can include a first portion 23*a* and a second portion 23*b* that is open to the first portion 23*a*. The first portion 23*a* is disposed adjacent the second portion 23*b* in the engagement direction 62. The width of the opening 23 at the second portion 23*b* can be greater than the combined width of the second housing body 52 and the flange 60 along the lateral direction. The width of the opening 23 at the first portion 23*a* can be greater than the width of the second housing body 52, but less than the combined width of the second housing body 52 and the flange 60. The second portion 23*b* of the opening 23 can be closed by a bottom wall 27*c* as illustrated in FIG. 2B. Alternatively, the second portion 23*b* can have a bottom end that is open to the outer perimeter of the substrate 22 in a plane that is defined by the lateral direction A and the transverse direction T.

Accordingly, the second electrical connector 26 can be placed behind the substrate 22, such that the second surface 22*b* is disposed between the second electrical connector 26 and the first surface 22*a*. The second electrical connector 26 can then be inserted through the second portion 23*b* of the opening 23 along the longitudinal direction L until the substrate 22 is disposed between the flange 60 and the electrical cables 50 with respect to the longitudinal direction L. In this regard, it should be appreciated that when the electrical contacts 32 are attached to the respective ones of the electrical cables 50, the electrical cables 50 are offset from the flange 60 along the longitudinal direction L a distance that is at least equal to the distance between the first and second surfaces 22*a* and 22*b* of the substrate 22 in the longitudinal direction L. The second electrical connector 26 can then be moved with respect to the substrate 22 in the engagement direction 62. Alternatively, when the bottom end of the second portion 23*b* is open to the outer perimeter of the substrate 22, the second electrical connector 26 can be placed adjacent the opening 23 and moved with respect to the substrate 22 along the transverse direction T so as to insert the second electrical connector 26 in the second portion 23*b* of the opening 23. Further movement of the second electrical connector 26 in the select direction relative to the substrate 22 causes the second electrical connector to be inserted in the first portion 23*a* of the opening 23. It should thus be appreciated that the second electrical connector 26 can be inserted into the opening 23 in the engagement direction 62 or in a direction perpendicular to the engagement direction.

Figure 4G:
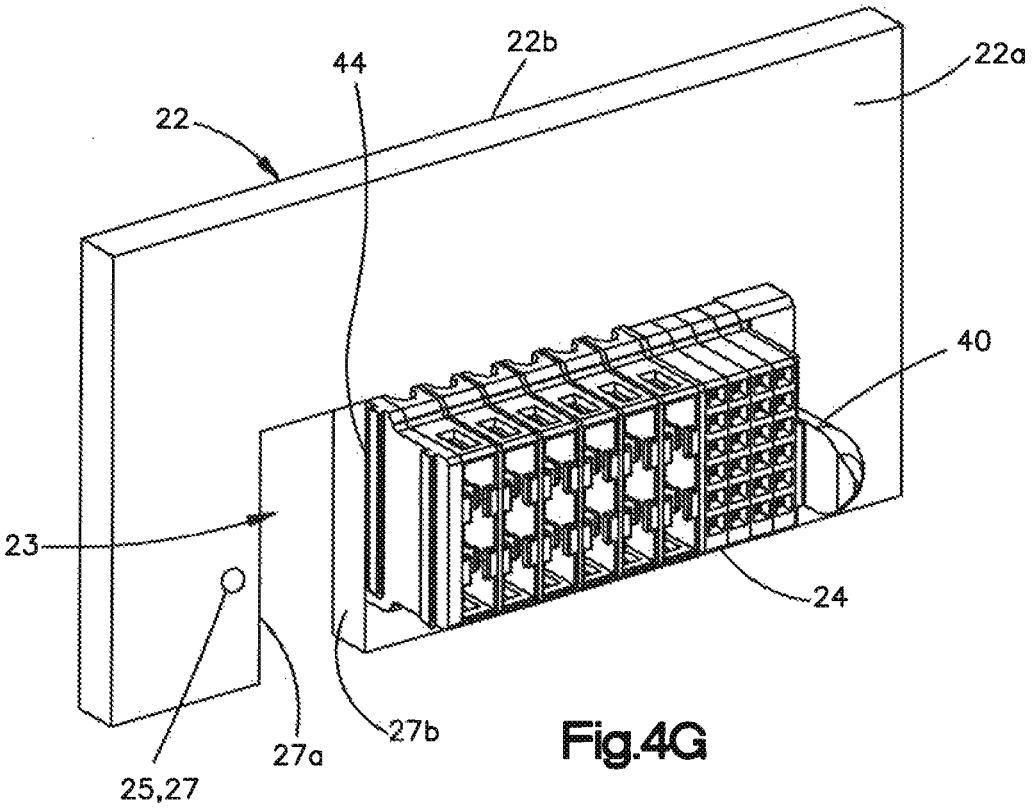
FIG. 4G is a perspective view of a portion of the electrical system, showing the first electrical connector mounted to the substrate similar to FIG. 2B, but showing the substrate constructed in accordance with another embodiment.
Figure 4H:
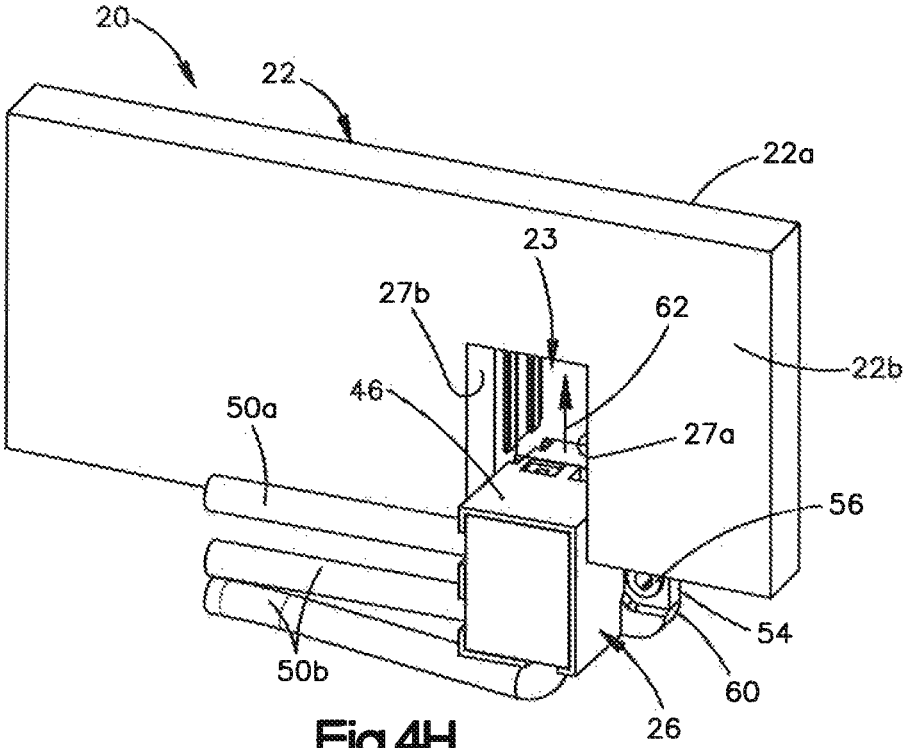
FIG. 4H is a perspective view showing attachment of the second electrical connector to the first electrical connector that is mounted to the substrate as illustrated in FIG. 4G.

Referring now to FIGS. 4G-4H, in accordance with another embodiment, an entirety of the opening 23 can be configured as described above with respect to the first portion 23*a*, and can extend through the outer perimeter of the substrate 22. Thus, an entirety of the opening 23 can have a width that is greater than the width of the second housing body 52 along the lateral direction A, and less than the combined width of the second housing body and the flange 60. Accordingly, the second electrical connector 26 can be positioned such that a plane that is defined by the lateral direction A and the transverse direction T and is coincident with the substrate 22 extends between the flange 60 and the electrical cables 50. The second electrical connector 26 can then be moved in the engagement direction 62 with respect to the first electrical connector 24 and the substrate 22, such that the second housing body 52 is inserted through the perimeter of the substrate 22 and into the opening, where the second electrical connector 26 attaches to the first electrical connector 24 as will now be described in detail.

In particular, referring now to FIGS. 4B-4H, and as described above, the second electrical connector 26 is configured to attach to the first electrical connecter 24 as the second electrical connector 26 moves relative to the first electrical connector 24 and the substrate 22 in the engagement direction 62. As described above, the engagement direction 62 is oriented along a direction that is perpendicular to the longitudinal direction L. For instance, the second electrical connector 26 is configured to attach to the first electrical connecter 24 as the second electrical connector 26 moves relative to the first electrical connector 24 along the transverse direction T. In particular, second electrical connector 26 is configured to attach to the first electrical connector 24 as the second electrical connector 26 moves relative to the first electrical connector 24 in the engagement direction 62. The engagement direction 62 can be in an upward direction, opposite gravitational forces that bias the second electrical connector in a downward direction opposite the engagement direction 62. In accordance with one example, the first electrical connector 24 is mounted to the substrate 22 prior to attachment of the second electrical connector 26 to the first electrical connector 24.

The second connector housing 46 can include a second attachment member 64 that is configured to attach to the first attachment member 44 of the first electrical connector 24 so as to attach the second electrical connector 26 to the first electrical connector 24. The second attachment member 64 can be supported by the second housing body 52. For instance, the second attachment member 64 can be monolithic with the second housing body 52, attached to the second housing body 52, or otherwise supported by the second housing body 52 as desired. The second attachment member 64 is configured to attach to the first attachment member 44 of the first electrical connector 24 when the second electrical connector 26 is moved with respect to the first electrical connector 24 in the engagement direction 62.

In one example, one of the first and second attachment members 44 and 64 is configured as at least one rail 66, and the other of the first and second attachment members 44 and 64 is configured as at least one groove 68 that is sized to receive the at least one rail 66. The leading end of the rail 66 can be chamfered so as to assist in insertion and retention of the rail 66 in the groove 68. Further, the rail 66 and groove 68 can engage in a dovetail arrangement. The first and second attachment members 44 and 64 can be elongate in the second or transverse direction T. In one embodiment, the first attachment member 44 of the first electrical connector 24 is configured as the at least one rail 66, and the second attachment member is configured as the at least one groove 68. Thus, the rail 66 can extend out from the first housing body 38, and the groove 68 can be at least partially defined by one of the side walls 70 of the second connector housing 46. In another embodiment, the second attachment member 64 of the second electrical connector 26 can be configured as the at least one rail 66, and the first attachment member 44 of the first electrical connector 24 can be configured as the at least one groove 68. Thus, the rail 66 can extend out from the second housing body 52, and the groove 68 can be at least partially defined by opposed side walls of the first housing body 38. The rails and grooves 66 and 68 can be elongate along the transverse direction T, and can extend a majority of a distance between opposed upper and lower surfaces of the respective electrical connector housings along the transverse direction T.

The first attachment member 44 defines a leading end 44*a* and a trailing end 44*b* with respect to engagement with the second attachment member 64. Thus, the leading end 44*a* and the trailing end 44*b* are spaced from each other along the transverse direction T. Similarly, the second attachment member 64 defines a leading end 64*a* and a trailing end 64*b* with respect to engagement with the first attachment member 44. Thus, the leading end 64*a* and the trailing end 64*b* are spaced from each other along the transverse direction T. The groove 68 has a first open end 71 and a second end opposite the first open end 71. The second end can be partially defined by a stop member 72. For instance, the stop member 72 can be opposite the open end 71 along the transverse direction T. Further, the stop member 72 can be aligned with the open end 71 along the transverse direction T. The first open end 71 of the groove 68 defines the leading end of the respective one of the first and second attachment members 44 and 64. The stop member 72 can define the trailing end of the respective one of the first and second attachment members 44 and 64. When the second electrical connector 26 includes the groove 68, the stop member 72 can be spaced from the open end 71 in a direction opposite the engagement direction 62. When first electrical connector 24 includes the groove 68, the stop member 72 can be spaced from the open end 71 in the engagement direction 62. The stop member 72 is configured to abut the rail 66 when the engagement member 54 of the second electrical connector 26 is aligned with a complementary engagement member 25 of the substrate 22 so as to facilitate securement of the second electrical connector 26 to the substrate 22.

For instance, when the engagement members 25 and 54 are aligned with each other, the fastener can be inserted through one of the engagement members 25 and 54 and at least into or through the other of the engagement members 25 and 54 so as to secure the second electrical connector 26 to the substrate 22. In one embodiment, the stop member 72 is configured to abut the rail 66 when the engagement member 54 of the second electrical connector 26 is aligned with the complementary engagement member 25 in the longitudinal direction L. The stop member 72 can be spaced from the open end 71 in the engagement direction, or in a direction opposite the engagement direction.

The rail 66 can be sized and configured to be press-fit in the groove 68 when the rail is fully inserted in the groove 68 such that the stop member 72 abuts the rail 66. As described above, the rails 66 is increasingly received in the groove 68 as the second electrical connector 26 is moved relative to the first electrical connector 24 in the engagement direction 62 along the transverse direction T. For instance, when the rail 66 is defined by the first connector housing 30 and the groove 68 is defined by the second connector housing 46, at least a portion of the rail 66 increases in thickness as it extends in the engagement direction 62 to a region of increased thickness that is configured to be press-fit in the groove 68 when the rail 66 is disposed in the groove 68. The region of increased thickness can be at the upper end of the rail 66. The thickness of the rail 66 can be measured along a direction perpendicular to the transverse direction T, such as one or both of the longitudinal direction L and the lateral direction A. Thus, a portion of the rail 66 can have a thickness that is greater than the thickness of the groove 68, such that the rail 66 becomes press-fit in the groove 68 so as to attach the second electrical connector 26 to the first electrical connector 24. Alternatively or additionally, at least a portion of the groove 68 can decrease in thickness as it extends in the direction opposite the engagement direction 62 to a region of decreased thickness. The region of decreased thickness can be sized to press-fit the rail 66 in the groove 68 when the rail 66 is disposed in the groove 68. The region of decreased thickness can be at the lower end of the groove 68. The thickness of the groove can be measured along a direction perpendicular to the transverse direction T, such as the longitudinal direction L. Thus, a portion of the groove 68 can have a thickness that is less than the thickness of the rail 66, such that the rail 66 becomes press-fit in the groove 68 so as to attach the second electrical connector 26 to the first electrical connector 24. The attachment of the second electrical connector 26 to the first electrical connector 24 resists gravitational threes and maintain alignment of the engagement members 54 and 25 so that the fastener can secure the second electrical connector 26 to the substrate 22.

As described above, the rail 66 can be defined by the second connector housing 46 and the groove 68 can be defined by the first connector housing 30. In this embodiment, at least a portion of the rail 66 increases in thickness as it extends in the direction opposite the engagement direction 62 to a region of increased thickness. The region of increased thickness can thus be at the lower end of the rail 66. The thickness of the rail 66 can be measured along a direction perpendicular to the transverse direction T, such as one or both of the longitudinal direction L and the lateral direction A. Thus, a portion of the rail 66 can have a thickness that is greater than the thickness of the groove 68, such that the rail 66 becomes press-fit in the groove 68 so as to attach the second electrical connector 26 to the first electrical connector 24 as described above. Alternatively or additionally, at least a portion of the groove 68 can decrease in thickness as it extends in the engagement direction to a region of decreased thickness. The region of decreased thickness can be sized to press-fit the rail 66 in the groove 68 when the rail 66 is disposed in the groove 68. The region of decreased thickness can be at the upper end of the groove 68. The thickness of the groove 68 can be measured along a direction perpendicular to the transverse direction T, such as the longitudinal direction L. Thus, a portion of the groove 68 can have a thickness that is less than the thickness of the rail 66, such that the rail 66 becomes press-fit in the groove 68 so as to attach the second electrical connector 26 to the first electrical connector 24.

As illustrated in FIGS. 4A-4F, the at least one rail 66 can include first and second rails, and the at least one groove 68 can include first and second grooves 68. The first and second rails can be oriented parallel to each other. Similarly, the first and second grooves can be oriented parallel to each other. It should be appreciated, of course, that the at least one rail 66 can be defined by one rail as illustrated in FIGS. 6A-6D, and the at least one groove 68 can be defined by one groove 68. It should be appreciated, of course, that the electrical connector assembly 28 can include any number of rails 66 and grooves 68 as desired, and that at least one of the grooves 68 can be at least partially defined by the stop member 72 in the manner described above. Further, at least one of the rails 66 can define the region of increased thickness. Alternatively or additionally, at least one of the grooves 68 can define the region of decreased thickness. Further still, the at least one rail 66 and the at least one groove 68 can have any suitable width in the longitudinal direction L as desired.

Figure 5:
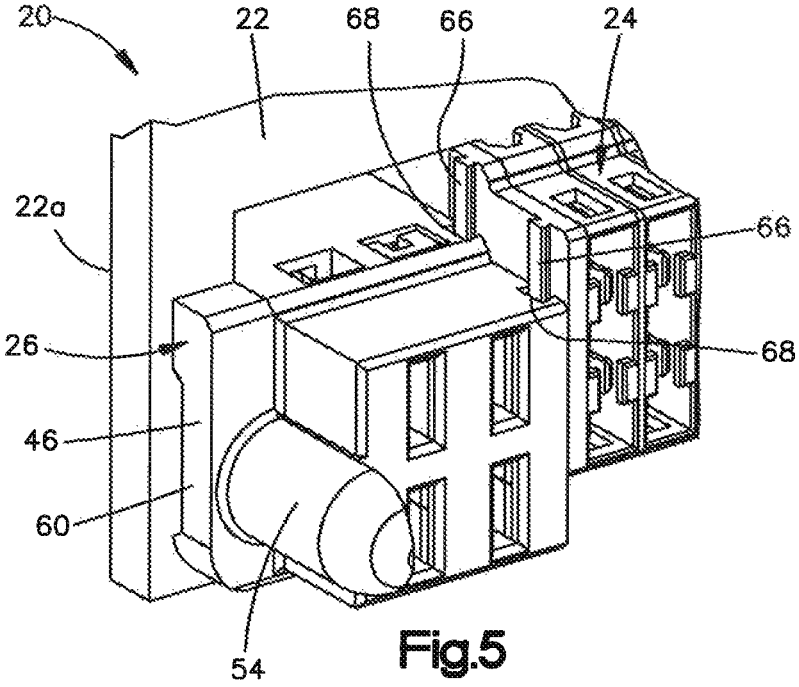
FIG. 5 is a perspective view showing removal of the second electrical connector from the substrate and the first electrical connector.
Figure 6A:
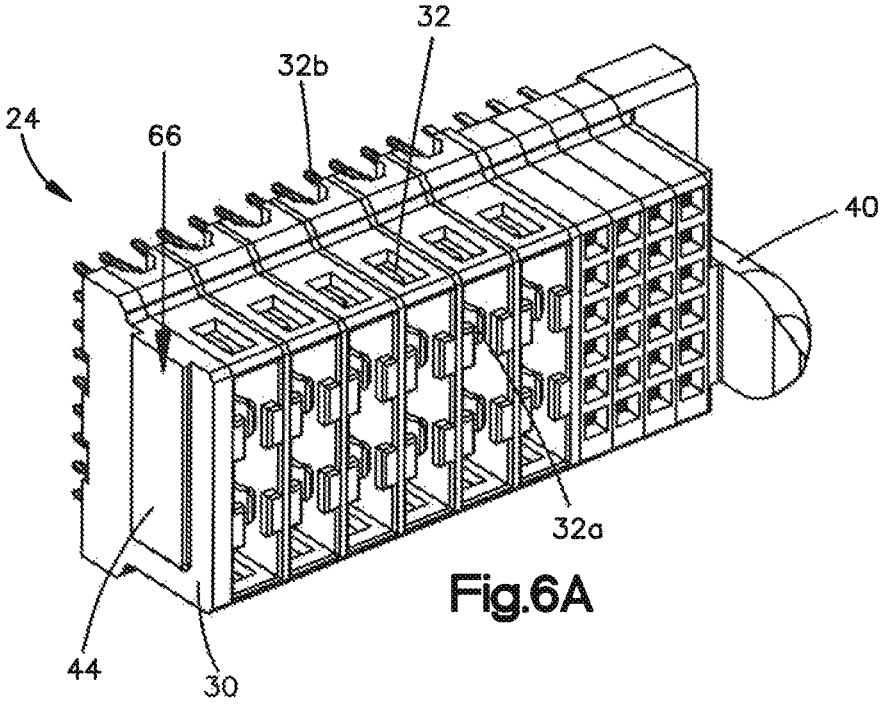
FIG. 6A is a perspective view of the first electrical connector constructed in accordance with an alternative embodiment.
Figure 6B:
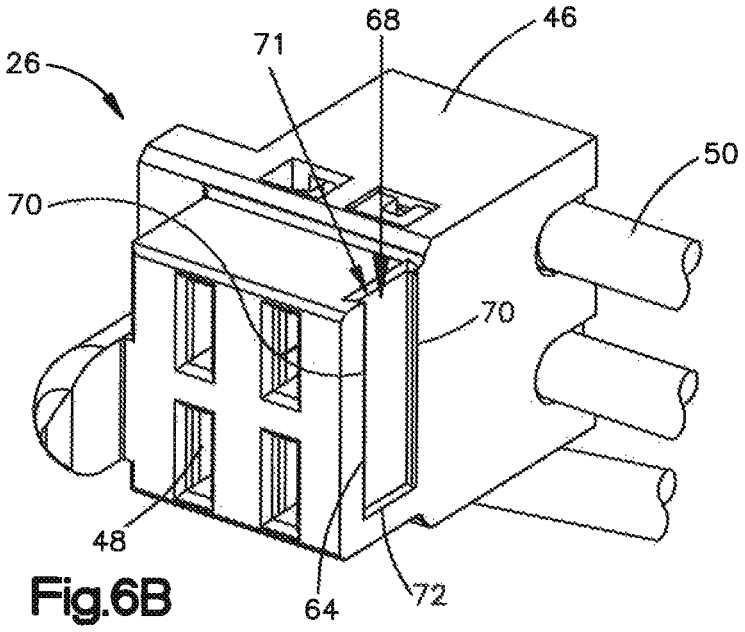
FIG. 6B is a perspective view of the second electrical connector constructed in accordance with an alternative embodiment.
Figure 6C:
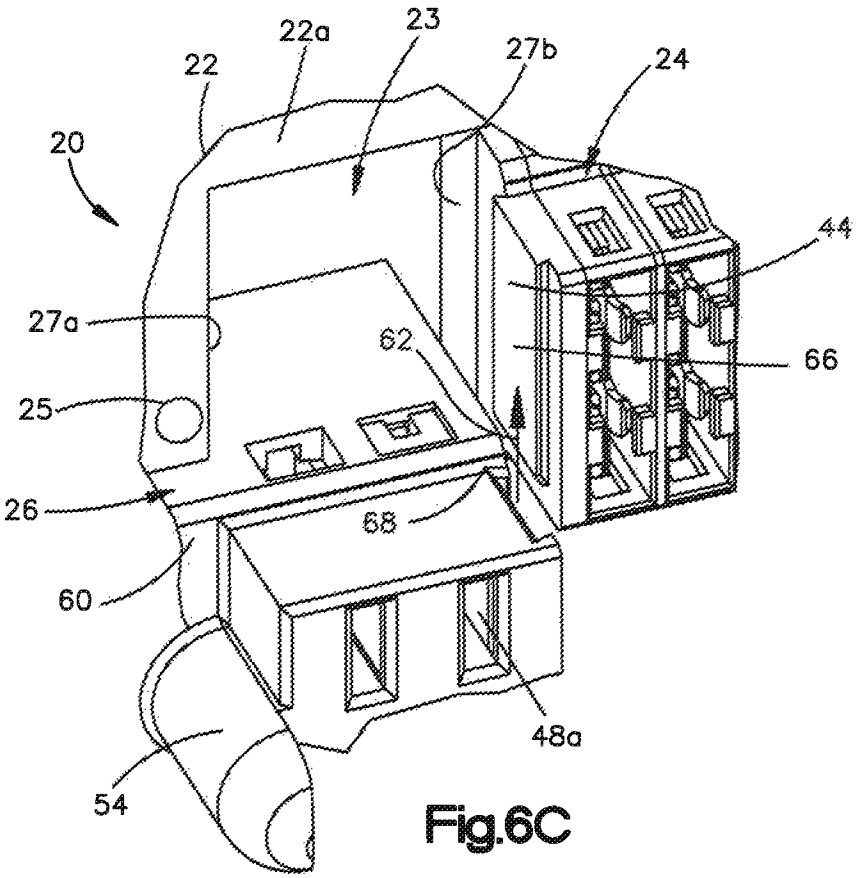
FIG. 6C is a perspective view showing attachment of the second electrical connector illustrated in FIG. 6B to the first electrical connector illustrated in FIG. 6A.
Figure 6D:
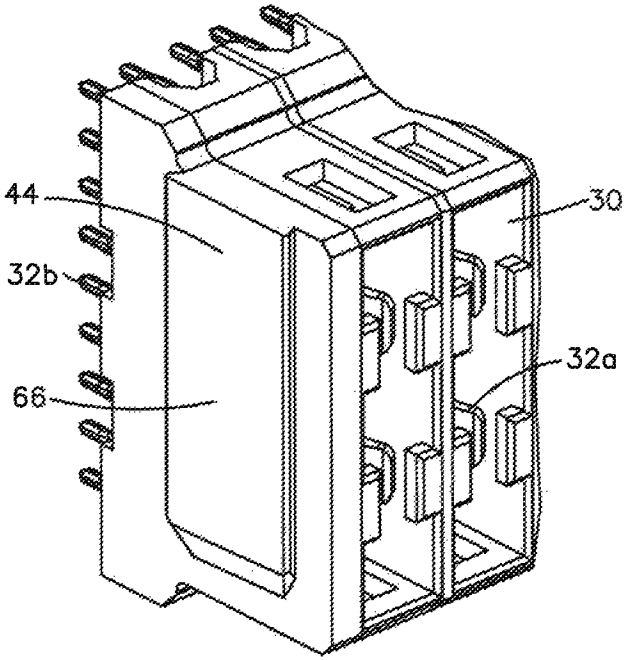
FIG. 6D is a perspective view of a portion of the first electrical connector illustrated in FIG. 6A.

Referring now to FIG. 5, it should be appreciated that the second electrical connector 26 can be removably attached to the first electrical connector 24. Accordingly, the second electrical connector 26 can be detached from the first electrical connector 24. For instance, the fastener 58 can be removed from one or both of the engagement members 54 and 25, and a sufficient force can be applied to the second electrical connector 26 relative to the first electrical connector in a disengagement direction opposite the engagement direction, thereby removing the rail 66 from the groove 68. The retention member can be removed from the second connector housing 46, and the interface between the second plurality of electrical contacts 48 and the electrical cables 50 can be removed from the second connector housing 46. The cables 50 can then be detached from the electrical contacts 48.

In other aspects of the present disclosure, it will be appreciated that methods are provided for causing the first and second electrical connectors 24 and 26 to be supported by the substrate 22. The method can include the step of mounting the first electrical connector 24 to the first surface 22*a* of the substrate 22. The method can further include the step of moving the second electrical connector 26 relative to the first electrical connector 24 along the transverse direction T so as to cause the second electrical connector 26 to attach to the first electrical connector 24 without mounting electrical contacts of the second electrical connector 26 to the substrate 22. After the moving step, the method can further include the step of securing the second electrical connector 26 to the substrate 22. The mounting step can further include the step of press-fitting mounting tails of the first plurality of electrical contacts 32 of the first electrical connector 24 into respective vias of the substrate 22. The moving step can include the step of aligning the engagement member 54 of the second electrical connector 26 with the engagement member 25 of the substrate 22. The method can further include the step of attaching the engagement member 54 of the second electrical connector 26 to the engagement member 25 of the substrate 22. For instance, as described above, the engagement member 54 of the second electrical connector 26 and the engagement member 25 of the substrate 22 can both define apertures, and the securing step can further include the step of inserting the fastener 58 through the one of the engagement members 25 and 54, and at least into the other of the engagement members 25 and 54. For instance, the method can include the step of inserting the fastener through the aperture of the substrate 22 and at least into the aperture of the second electrical connector 26. The fastener can threadedly mate with the second connector housing in the aperture.

The method can include the step of inserting the second electrical connector 26 into the opening 23 after the mounting step and before the moving step. As described above, the second electrical connector 26 includes a second plurality of electrical contacts 48 that are connected to a respective electrical cable 50, and the inserting step can cause the substrate 22 to be disposed between the engagement member 54 of the second electrical connector 26 and the electrical cables 50 with respect to the longitudinal direction L. The moving step can include the step of inserting the at least one rail 66 into the at least one groove so as to attach the second electrical connector 26 to the first electrical connector 24 without mounting the second electrical connector 26 to the substrate 22. For instance, the moving step can include the step of inserting the rail 66 into an open end 71 of the groove 68 until the rail 66 abuts a stop member 72 opposite the open end 71, thereby aligning the engagement member 54 of the second electrical connector 26 with an engagement member 25 of the substrate 22 along the first direction. At least one of the rail 66 and the groove 68 can vary in thickness along its length, such as along a direction that is perpendicular to the transverse direction T, which can be the longitudinal direction L, such that the step of inserting the rail 66 into the groove 68 comprises press-fitting the rail 66 in the groove 68 when the engagement member 54 of the second electrical connector 26 is aligned with the engagement member 25 of the substrate 22. The moving step can include the step of moving the second electrical connector 26 relative to the first electrical connector 24 against gravitational forces.

In another aspect of the present disclosure, a method for supporting the first and second electrical connectors 24 and 26 on the substrate 22 can include the steps of teaching or providing the first electrical connector 24, teaching or providing the second electrical connector 26, and teaching to a third party the steps of mounting, moving, and securing as described above. Further, the method can include the step of teaching to the third party the step of inserting the fastener as described above. The method can further include the step of teaching to the third party the step of inserting the second electrical connector 26 into the opening 23 of the substrate 22 as recited above. The method can further include the step of teaching to the third party the step of inserting the rail 66 into the groove 68 as described above.

The embodiments described in connection with the illustrated embodiments have been presented by way of illustration, and the present invention is therefore not intended to be limited to the disclosed embodiments. Furthermore, the structure and features of each the embodiments described above can be applied to the other embodiments described herein, unless otherwise indicated. Accordingly, those skilled in the art will realize that the invention is intended to encompass all modifications and alternative arrangements included within the spirit and scope of the invention, for instance as set forth by the appended claims.

What is claimed:

1. An electrical connector assembly comprising:

a first electrical connector including a dielectric first connector housing, and a first plurality of electrical contacts supported by the first connector housing, wherein the first electrical connector is configured to be mounted to a first surface of a substrate, wherein the substrate has a second surface offset from the first surface in along a first direction, and the first connector housing has a first housing surface perpendicular to the first surface;

a second electrical connector including a dielectric second connector housing with a second housing surface, and a second plurality of electrical contacts supported by the second connector housing, wherein the second electrical connector is configured to be moved relative to the first electrical connector along an engagement direction that is perpendicular to the first direction so as to attach the second electrical connector to the first electrical connector with the second housing surface facing the first housing surface after the first electrical connector has been mounted to the first surface of the substrate.

2. The electrical connector assembly as recited in claim 1, wherein the second electrical connector is configured to be secured to the substrate after the second electrical connector has been attached to the first electrical connector.

3. The electrical connector assembly as recited in claim 2, wherein the second plurality of electrical contacts are free from electrical communication with the substrate when the second electrical connector is secured to the substrate.

4. The electrical connector assembly as recited in any claim 1, wherein the second connector housing comprises an engagement member that is configured to cooperate with an engagement member of the substrate so as to secure the second electrical connector to the substrate.

5. The electrical connector assembly as recited in claim 4, wherein the second connector housing comprises a housing body and a flange that extends from the housing body, wherein the flange defines the engagement member.

6. The electrical connector assembly as recited in claim 5, wherein at least some of the second plurality of electrical contacts are connected to a respective one of a plurality of electrical cables.

7. The electrical connector assembly as recited in claim 6, wherein the cables are offset from the flange along the first direction a distance that is at least equal to a distance between the first and second surfaces of the substrate in the first direction, and the substrate is disposed between the flange and the cables when the first electrical connector is mounted to the substrate and the second electrical connector is attached to the first electrical connector.

8. The electrical connector assembly as recited in claim 7, wherein the at least one of the cables extends out from the second connector housing along a third direction perpendicular to both the first and second directions.

9. The electrical connector assembly as recited in claim 1, wherein one of the first and second electrical connectors comprises at least one rail, and the other of the first and second electrical connectors defines at least one groove sized to receive the rail as the second electrical connector moves relative to the first electrical connector in the engagement direction.

10. The electrical connector assembly as recited in claim 9, wherein the groove has a first end that is open and a second end that is opposite the first end and defines a stop member, and the stop member is configured to abut the rail when the second electrical connector is aligned to be secured to the substrate.

11. The electrical connector assembly as recited in claim 10, wherein the open end and the stop member are aligned with each other in the engagement direction.

12. The electrical connector assembly as recited in claim 9, wherein the rail is sized and configured to be press-fit in the groove.

13. The electrical connector assembly as recited in claim 9, wherein the groove receives the rail in a dovetail arrangement.

14. The electrical connector assembly as recited in claim 1, wherein the engagement direction is opposite gravitational forces.

15. The electrical connector assembly as recited in claim 1 further comprising the substrate.

16. An electrical system, comprising:

a first electrical connector including a dielectric first connector housing, and a first plurality of electrical contacts supported by the first connector housing, wherein the first electrical connector is configured to be mounted to a first surface of a substrate, the substrate having a second surface offset from the first surface along a first direction;

a second electrical connector including a dielectric second connector housing, and a second plurality of electrical contacts supported by the second connector housing, wherein the second electrical connector is configured to be moved relative to the first electrical connector along an engagement direction that is perpendicular to the first direction so as to attach the second electrical connector to the first electrical connector after the first electrical connector has been mounted to the first surface of the substrate; and the substrate, wherein the substrate defines an opening that extends from the first surface to the second surface, and wherein the opening is configured to receive the second electrical connector in at least one of the first direction and the engagement direction.

17. The electrical system as recited in claim 16, wherein the opening is configured to receive the second electrical connector so as to align the second electrical connector for attachment to the first electrical connector in the engagement direction.

18. A method for causing first and second electrical connectors to be supported by a substrate, the substrate having a first surface and a second surface offset from the first surface along a first direction, the method comprising the steps of:

mounting a first electrical connector to the first surface of the substrate adjacent an opening in the substrate;

after the mounting step, positioning the second electrical connector with respect to the opening such that motion of the second electrical connector is enabled and moving the second electrical connector relative to the first electrical connector in an engagement direction perpendicular to the first direction, so as to cause the second electrical connector to attach to the first electrical connector without mounting the second electrical connector to the substrate; and after the moving step, securing the second electrical connector to the substrate.

19. The method as recited in claim 18, wherein the moving step comprises aligning an engagement member of the second electrical connector with an engagement member of the substrate.

20. The method as recited in claim 19, further comprising the step of securing the second electrical connector directly to the substrate.

* * * * *